US007510380B2

(12) United States Patent
Alam et al.

(10) Patent No.: US 7,510,380 B2
(45) Date of Patent: Mar. 31, 2009

(54) NON-PARALLEL SPACER FOR IMPROVED ROTOR GROUP BALANCE

(75) Inventors: Mohsiul Alam, Chandler, AZ (US); Scott J. Freestone, Chandler, AZ (US); Walter L. Meacham, Phoenix, AZ (US); Paul B. Talbert, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 392 days.

(21) Appl. No.: 11/213,178

(22) Filed: Aug. 26, 2005

(65) Prior Publication Data

US 2007/0009360 A1 Jan. 11, 2007

Related U.S. Application Data

(63) Continuation-in-part of application No. 11/176,537, filed on Jul. 6, 2005.

(60) Provisional application No. 60/587,913, filed on Jul. 13, 2004.

(51) Int. Cl.
*F01D 5/02* (2006.01)

(52) U.S. Cl. ..... 416/244 R; 416/244 A

(58) Field of Classification Search ..... 416/244 R, 416/244 A, 204 A, 204 R, 223 B, 244 B; 411/537, 538, 275, 230, 936
See application file for complete search history.

(56) References Cited

U.S. PATENT DOCUMENTS 3,689,177 A 9/1972 Klassen
4,009,568 A 3/1977 King et al.
4,310,286 A 1/1982 Peters et al.
4,730,982 A 3/1988 Kervistin
4,737,076 A 4/1988 Bonner et al.
4,901,523 A 2/1990 Huelster
5,105,625 A 4/1992 Bell, III et al.
5,169,297 A * 12/1992 Mizuno et al. ..... 417/407
5,279,031 A 1/1994 Carruthers et al.
5,289,677 A 3/1994 Jarrell
5,537,814 A 7/1996 Nastuk et al.
5,605,442 A * 2/1997 Wilson et al. ..... 415/206
5,628,621 A 5/1997 Toborg
6,146,074 A * 11/2000 Tutikawa ..... 411/275
6,250,883 B1 6/2001 Robinson et al.
6,309,177 B1 10/2001 Swiderski et al.

* cited by examiner

*Primary Examiner*—Edward Look
*Assistant Examiner*—Dwayne J White
(74) *Attorney, Agent, or Firm*—Ingrassia Fisher & Lorenz, P.C.

(57) ABSTRACT

The present invention provides apparatus and methods for balancing stacked components of rotating machinery, such as in a gas turbine engine. Unlike conventional processes and devices for balancing stacked components, the present invention may use a single non-parallel spacer for obtaining an acceptable and repeatable component group balance. The non-parallel spacer may be used to compensate for rotor bow and the associated imbalance of the rotor group. By indexing a spacer with non-parallel faces, situated terminally at the end of the stack adjacent to the nut, rotor balance can be achieved without disassembly of the rotor group and clocking of its individual components. A spacer may also be disposed at any one or more of the interfaces between various components in the stack.

22 Claims, 17 Drawing Sheets

NON-PARALLEL SPACER FOR IMPROVED ROTOR GROUP BALANCE

CROSS-REFERENCE TO RELATED APPLICATIONS

This application is a continuation-in-part of U.S. patent application Ser. No. 11/176,537, filed on Jul. 6, 2005, which claims the benefit of U.S. Provisional Patent Application No. 60/587,913, filed on Jul. 13, 2004. The disclosure of U.S. patent application Ser. No. 11/176,537, filed on Jul. 6, 2005 is incorporated by reference herein in its entirety.

BACKGROUND OF THE INVENTION

The present invention generally relates to balancing stacked components of rotating machinery, and more specifically, to achieving group balance of a turbine rotor assembly.

Gas turbine engines include rotating components such as fans, compressors, and turbines. The components are clamped together axially either by a tieshaft or bolted flange joints. In many applications, nuts and bolts are used to apply compressive forces on multiple components, securing them in a stacked relation on the shaft. The compressive force through the components is equal to the tensile force in the shaft, which stretches proportionally to the original shaft length.

In gas turbine engines, a nut is often used on the end of a threaded shaft to secure and position the engine components relative to the shaft. The shaft traditionally has a radial flange extending outward at one end to provide an abutting surface and threads for the nut at the opposite end. The engine components are stacked along the shaft such that the shaft extends through the center of the components. The nut is threaded to the shaft to apply a compressive force through the components that secures them in place relative to the shaft, and thus, engages pilots of the components. Proper balancing and piloting of the components on the shaft is required to achieve an acceptable balance of the group when assembled. The tieshaft may serve other functions in addition to securing the outer stack of components, such as providing a location for mounting of bearings, and power transfer to another shaft via a spline. Alternatively, a single shaft and nut system may serve simply to axially secure an outer stack of rotating components.

The process of balancing a rotor group, e.g., for a gas turbine engine component stack, can be time consuming and costly. The primary sources of unbalance in a rotor group are component unbalance and rotor bow. A problem occurs when the stacked components are axially loaded, e.g., with a nut threaded on a tie-shaft. Non-parallel features of the components cause rotor bow resulting in unbalance of the rotor group. Component unbalance is typically very low; often less than 50% of the desired group unbalance level. Rotor bow can result in components having an unbalance level when assembled in the group level much larger than the level they were balanced to as a component. Typical increases in component unbalance due to rotor bow can be in the order of 2-5 times (2× to 5×).

Each of the rotor components may be balanced before assembly of the rotor group. The balance of the group is then checked after assembly. If the group does not meet its established limits, a component of the group must be rotated. Balance is again checked and, if necessary, another component is rotated. This process is repeated in an iterative fashion until group balance is achieved. Clocking of components can be time consuming, leading to higher product cost. Clocking of a single component can take 30 minutes or more. In many situations, components are pressed onto other components, resulting in even more time to clock the components. Many groups can require clocking of components four or five time Various designs controlling rotor runouts in relation to the associated static structure have been proposed in the prior art. One such conventional design is disclosed in U.S. Pat. No. 4,901,523 to Huelster ("Huelster patent"). The Huelster patent discloses an adjustable annular shim pack that is used to minimize running clearances between compressor/turbine blade tips and a static structure. The design disclosed in the Huelster patent is not capable of controlling group balance in the case presented by Huelster. By using the shim pack of Huelster, correcting for running clearances might increase rotor unbalance.

As can be seen, there is a need for improved apparatus and methods for achieving group balance of stacked components, including balance repeatability.

SUMMARY OF THE INVENTION

In one aspect of the present invention, a rotor assembly comprises a shaft, at least one rotor disposed on the shaft, a nut for axially loading the at least one rotor on the shaft, the shaft having a threaded portion for receiving the nut, and a non-parallel spacer disposed between the nut and the at least one rotor.

In another aspect of the present invention, there is provided a rotating component stack for a turbine system, comprising a rotor stack including a shaft-receiving bore axially defined therein; a tie-shaft disposed within the shaft-receiving bore; a nut for axially loading the rotor stack and the tie-shaft, the rotor stack and the nut having a common axis and fixed in relation to each other, the nut having a nut axial facing surface and a nut axial mating surface; a non-parallel spacer disposed axially between the nut and the rotor, wherein the non-parallel spacer is configured for correcting rotor bow of the rotor stack; and a floating ring disposed radially outward from the non-parallel spacer, the floating ring configured for piloting the nut.

In still a further aspect of the present invention, there is provided a rotor assembly comprising a shaft having a proximal threaded portion, a plurality of rotor components stacked on the shaft, a nut disposed on the proximal threaded portion of the shaft, and a T-spacer disposed on the shaft, wherein the T-spacer is disposed between the nut and one of the plurality of rotor components, and at least one of the T-spacer and the nut has non-parallel axial surfaces.

In yet a further aspect of the present invention, a method for correcting rotor bow for a rotor group stacked on a shaft comprises mounting a non-parallel spacer on the shaft, the non-parallel spacer having a spacer first axial surface and a spacer second axial surface, the first axial surface and the second axial surface having a pre-defined non-parallelism therebetween; and mounting a nut on a threaded portion of the shaft such that at least one of the spacer first axial surface and the spacer second axial surface mates with an axial face of at least one component of the rotor group.

These and other features, aspects, and advantages of the present invention will become better understood with reference to the following drawings, description, and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention provides an apparatus and method for balancing stacked components of rotating machinery, such as a stacked rotor group for a gas turbine engine. While the following description pertains to a gas turbine engine, it is to be understood that the present invention may also be used in various other types of rotating machinery, such as a turbocharger, a generator, and the like.

Unlike conventional designs for clocking stacked components or balancing stacked components, the present invention may use a non-parallel spacer for obtaining group balance of a rotor group or stack, for example, by reducing rotor bow. Additionally, conventional processes for achieving group balance of stacked components require balance material removal from a group, or numerous assembly/disassembly iterations to achieve group balance. Prior art processes for the insertion of shims in flanged attachments can reduce the runout of a rotor in relation to the stator, however, such conventional processes do not address group balance, and shims are required at each component interface to reduce runout across the rotor group to acceptable levels.

In contrast to conventional balance control, and according to an embodiment of the present invention, a single spacer with non-parallel axial surfaces may be used to achieve rotor balance of a component stack. The single non-parallel spacer may be disposed between the nut and the last component on the stack. Alternatively, a non-parallel spacer may also be disposed at any one or more of the interfaces between each component of the stack.

By indexing a non-parallel spacer disposed at the end of the stack with the nut, one can achieve rotor balance without disassembly of the rotor group and individual clocking of components. Piloting the nut on the outside diameter of the nut enables enhanced repeatability of group balance as well as increased group balance magnitude. Apparatus for outside diameter nut piloting for improved rotor balance was disclosed in commonly assigned, co-pending U.S. patent application Ser. No. 11/176,537, filed Jul. 6, 2005, the disclosure of which is incorporated by reference herein in its entirety.

Figure 1A:
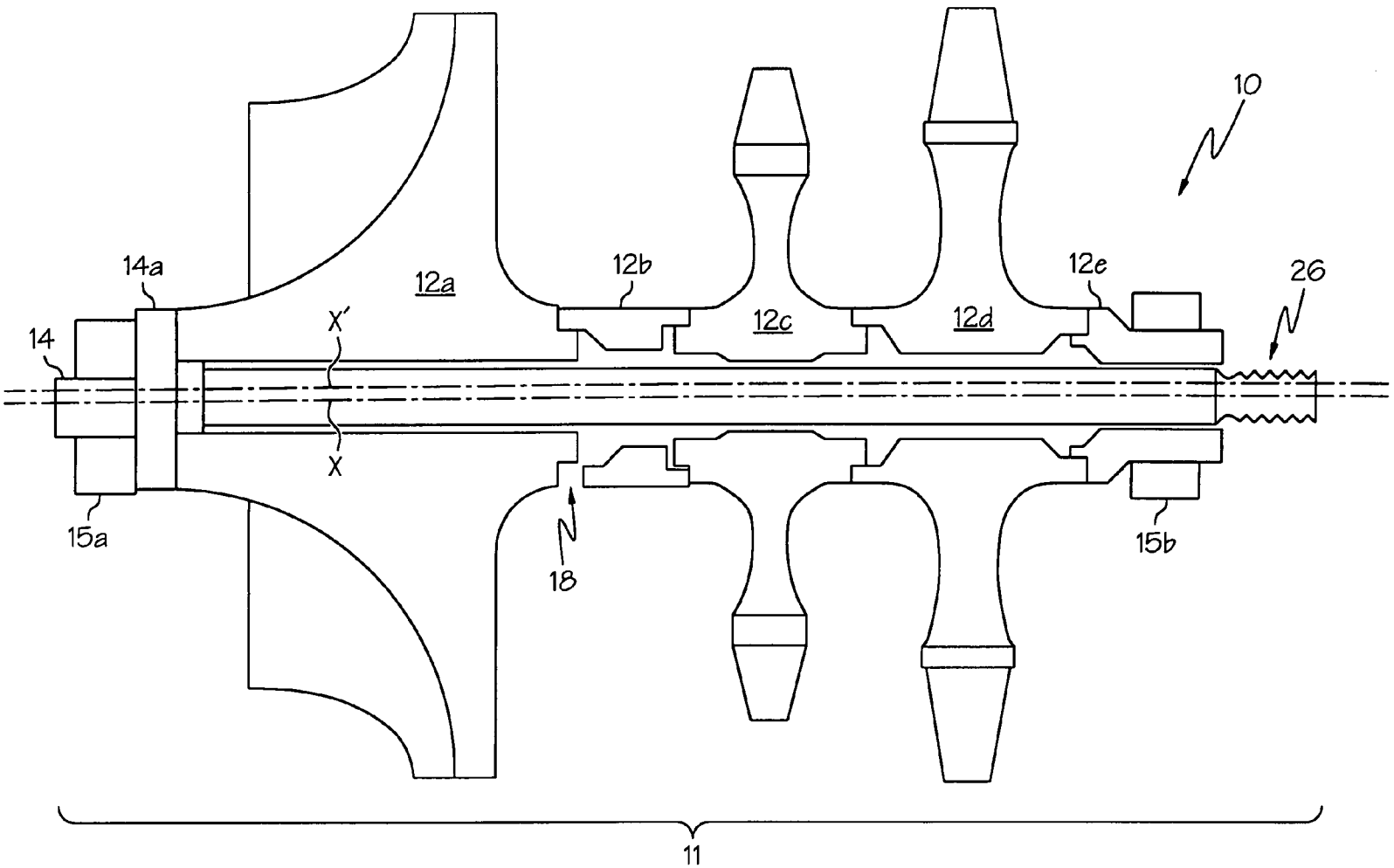
FIG. 1A is an axial sectional view of a component stack prior to axial loading thereof, according to one aspect of the present invention.

FIG. 1A is an axial sectional view of a component stack 11 of a rotor assembly 10 prior to axial loading thereof. Prior to axial loading, component stack 11 may not exhibit rotor bow (see, for example, FIG. 1B). Rotor assembly 10 may comprise a shaft 14 which may include a distal flange 14*a* and a proximal threaded portion 26, the latter adapted for receiving a nut (see, e.g., FIG. 1B). Rotor stack may include a plurality of rotor components, for example, first, second, third, fourth, and fifth components 12*a-e*, respectively. It is to be understood that the invention is not limited to a particular number or type of rotor components.

Rotor assembly 10 may be supported by at least two bearings, 15*a*, 15*b*. The centerline or axis of rotation, as defined by bearings 15*a* and 15*b*, of component stack 11 may be shown by the line X. The mass center of component stack 11 may be shown by the line X'. The mass center of one or more of first, second, third, fourth, and fifth components 12*a-e* may be non-concentric with the axis of rotation X. Typically, one or more of first, second, third, fourth, and fifth components 12*a-e* may have non-parallel axial faces. For example, an axial gap 18 may exist between first and second components 12*a*, 12*b*, due to second component 12*b* having non-parallel axial faces. Imbalance of component stack 11 may be due to unbalance, or mass offset, of one or more components of component stack 11 and from inappropriate radial positioning of one or more components of component stack 11 relative to the axis of rotation, X, of component stack 11. Imbalance of component stack 11 may lead to problems such as engine vibration.

Figure 1B:
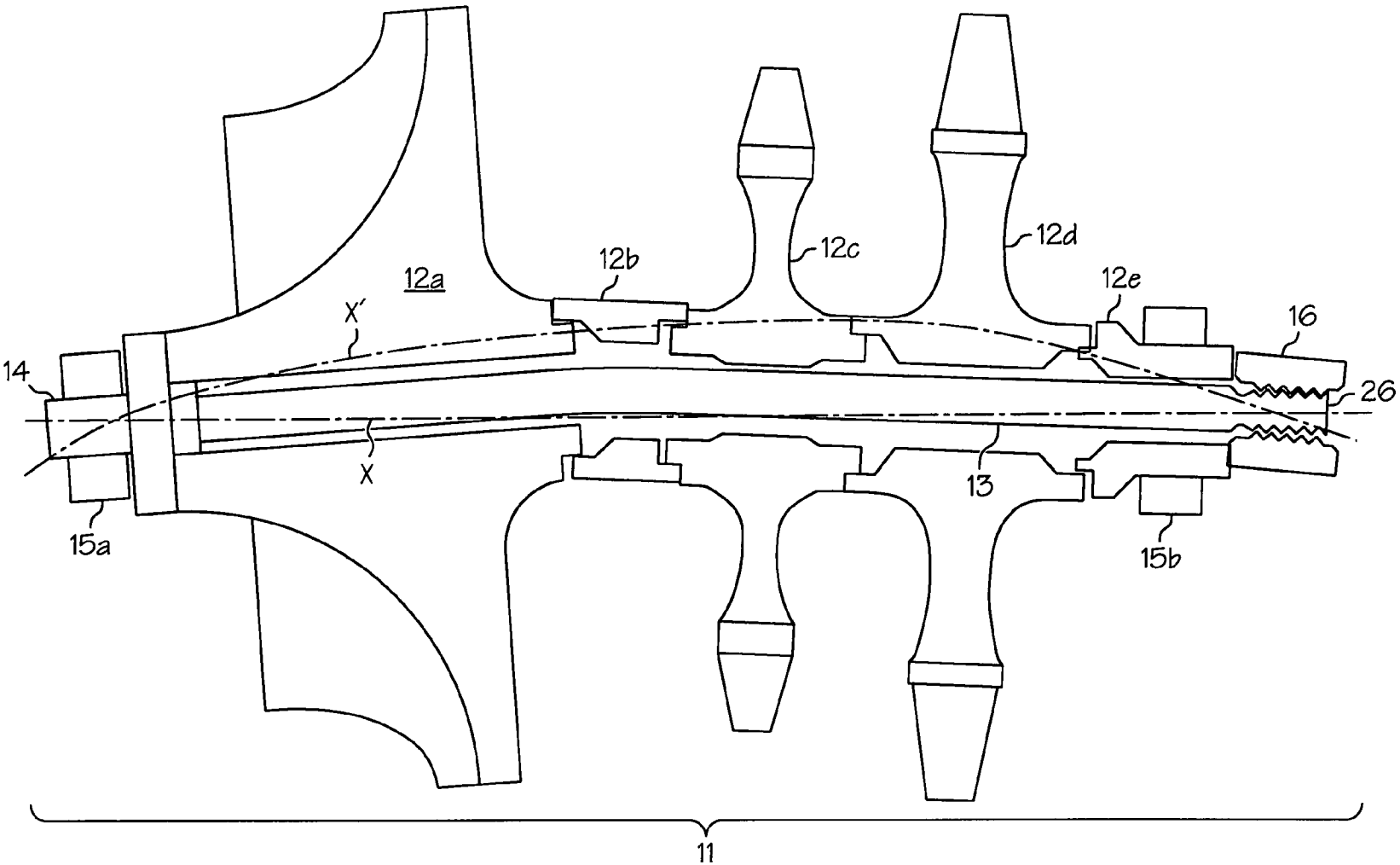
FIG. 1B is an axial sectional view of a component stack showing rotor bow after axial loading of the component stack, according to the present invention.

FIG. 1B is an axial sectional view of the component stack 11 of FIG. 1A after axial loading thereof, showing rotor bow in which shaft 14 may be bowed or bent away from the axis of rotation, X. Axial loading may be achieved by threading a nut 16 on proximal threaded portion 26 of shaft 14. When shaft 14 is bowed as shown in FIG. 1B, the mass center, represented by line X', may further diverge from the axis of rotation, X. Note that the axial gap 18 (between first and second components 12*a*, 12*b*, FIG. 1A) may be eliminated or decreased upon axial loading of component stack 11, e.g., via tightening nut 16 on proximal threaded portion 26 of shaft 14. Nut 16 may comprise, as non-limiting examples, a material such as an alloy of iron, steel, nickel, cobalt, titanium, or aluminum.

Rotor bow as shown in FIG. 1B may be a typical rotor bow resulting from one or more of components having non-parallel faces, which results in a mass center-of-gravity offset, commonly referred to as unbalance. Shaft 14 may have a yield strength and be preloaded in tension by nut 16 to a predetermined percentage of the yield strength.

Figure 2A:
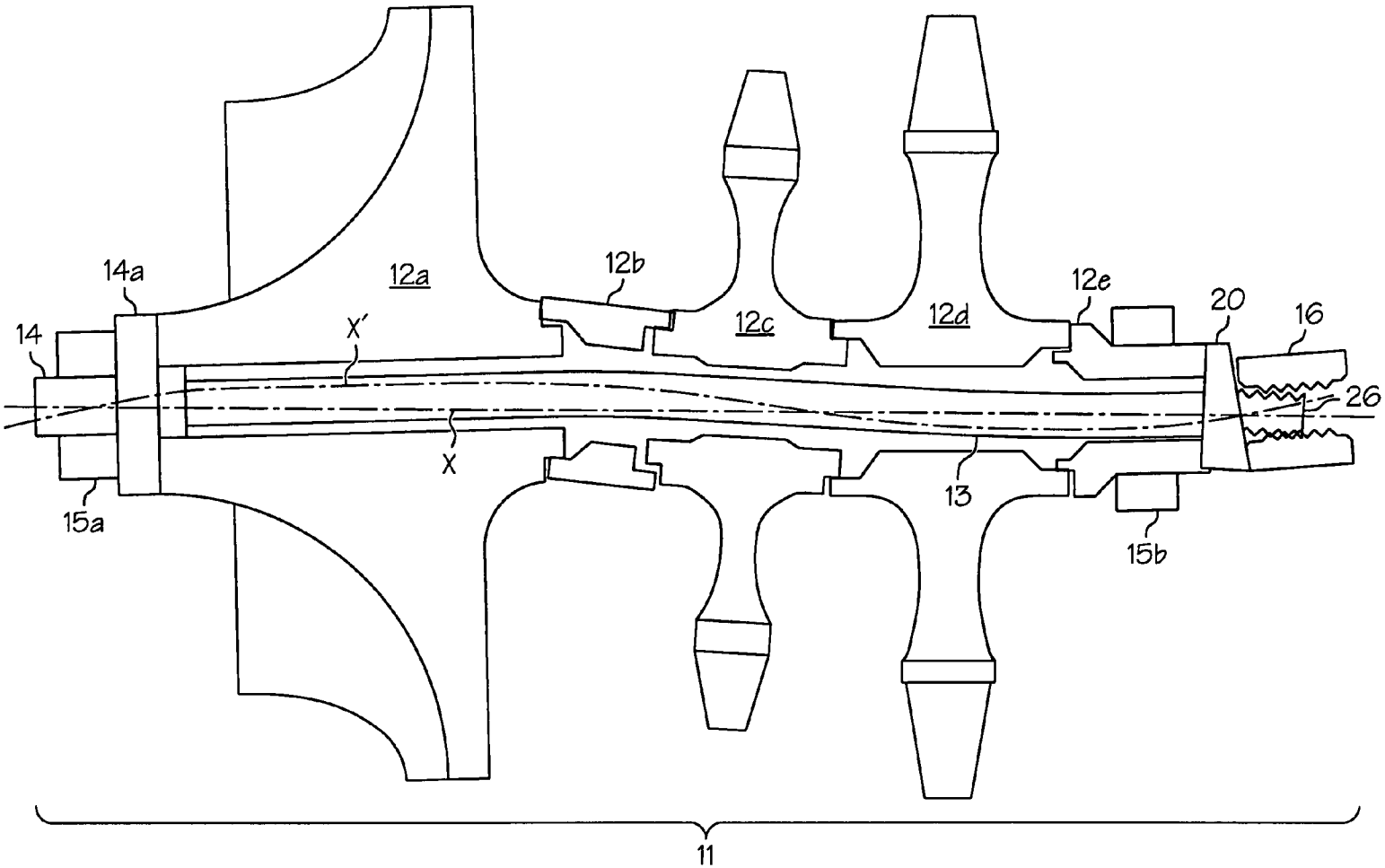
FIG. 2A is an axial sectional view of an axially loaded component stack including a non-parallel spacer, according to an embodiment of the present invention.

As shown in FIG. 2A, placing a non-parallel spacer 20 on shaft 14 may eliminate or decrease rotor bow of component stack 11, such that component stack 11 may be aligned more closely to an ideal condition (in which the mass center represented by line X' may be coaxial with axis of rotation, X). In some embodiments, non-parallel spacer 20 may be disposed between nut 16 and a proximal component of rotor stack 11, e.g., between nut 16 and fifth component 12*e* in FIG. 2A.

Figure 2C:
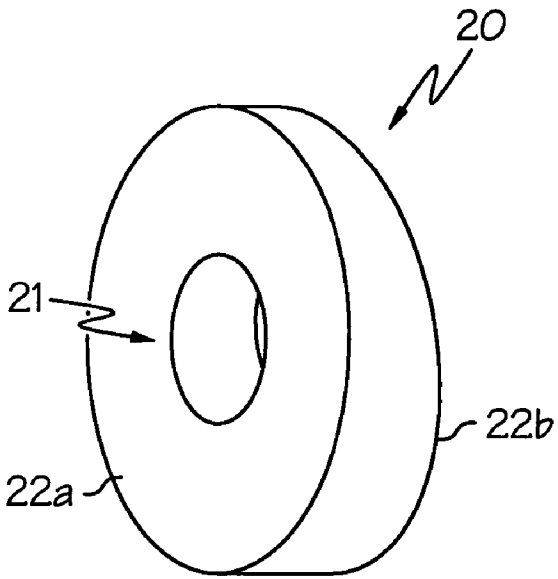
FIG. 2C is a perspective view of a non-parallel spacer, according to an embodiment of the present invention.
Figure 2B:
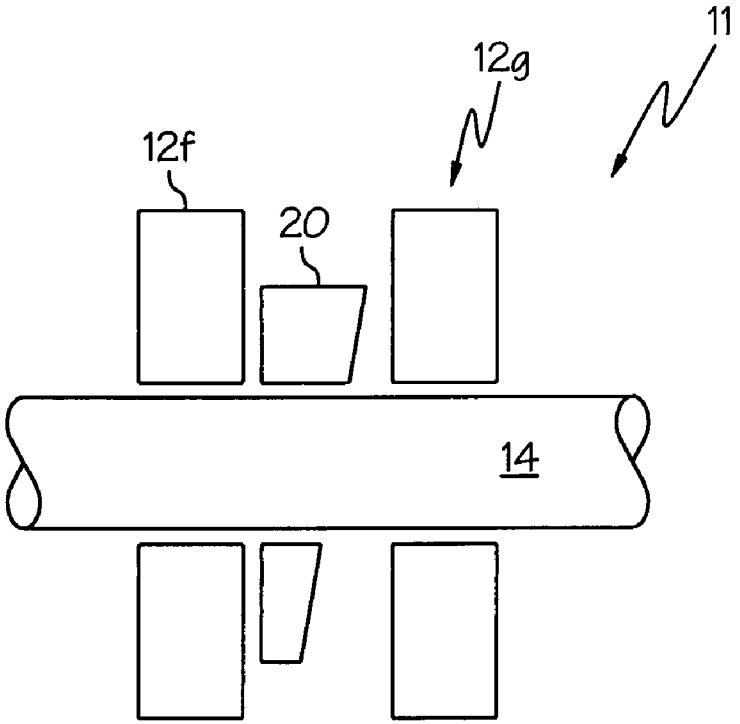
FIG. 2B is an axial sectional view of a portion of a component stack showing a non-parallel spacer axially disposed between two adjacent rotor components of the component stack, according to an embodiment of the present invention.

In alternative embodiments, non-parallel spacer 20 may be disposed between two adjacent components of component stack 11, e.g., between sixth component 12f and seventh component 12g, as shown in FIG. 2B. Although, a single non-parallel spacer 20 is shown in FIGS. 2A-B, it is to be understood that component stack 11 may comprise more than one non-parallel spacer 20, and furthermore, that a plurality of non-parallel spacers 20 may be configured at various locations with respect to various components on shaft 14.

FIG. 2C is a perspective view of a non-parallel spacer 20 which may be generally disc-shaped structure having a spacer first axial surface 22*a*, a spacer second axial surface 22*b*, and a bore 21 therethrough for mounting non-parallel spacer 20 on shaft 14. In the embodiment of FIG. 2A, spacer first axial surface 22*a* may mate with an axial facing surface of fifth component 12*e*, and spacer second axial surface 22*b* may mate with an axial surface of nut 16. In the embodiment of FIG. 2B, spacer first axial surface 22*a* may mate with an axial facing surface of sixth component 12f, and spacer second axial surface 22*b* may mate with an axial facing surface of seventh component 12*g*.

Figure 3B:
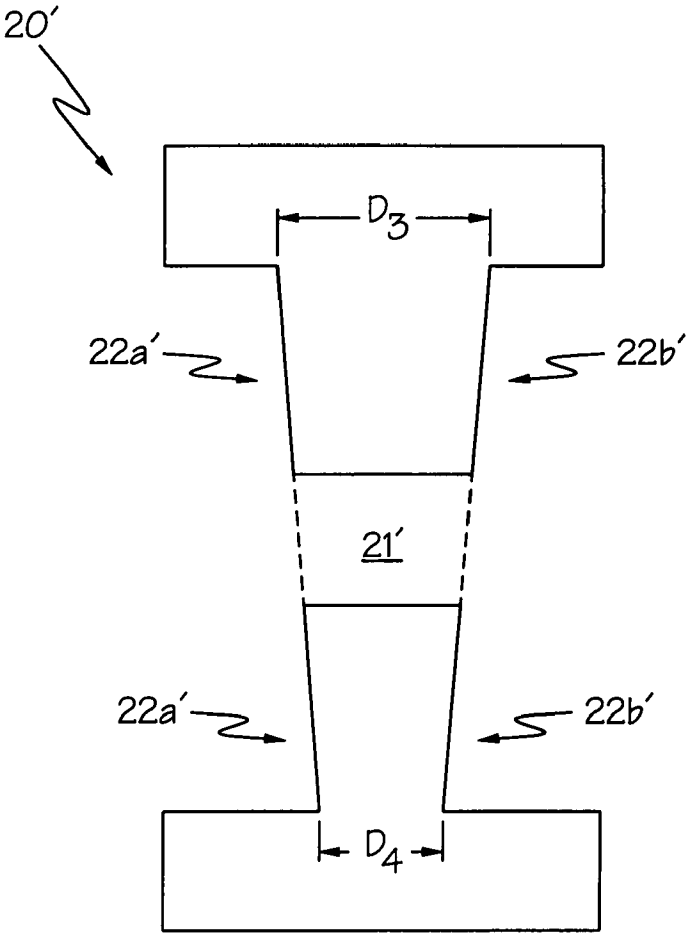
FIGS. 3A and 3B each show a sectional view of a non-parallel spacer, according to various embodiments of the present invention.
Figure 3A:
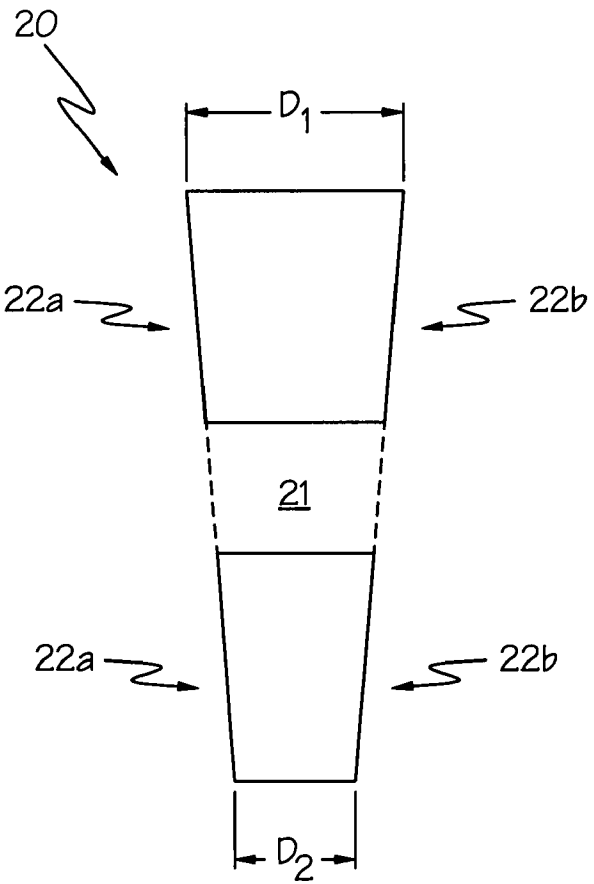

FIG. 3A is a sectional view of a non-parallel spacer 20, according to an embodiment of the present invention. Non-parallel spacer 20 may include a spacer first axial surface 22*a* and a spacer second axial surface 22*b*. A first width, D1, of non-parallel spacer 20 may be greater than a second width, D2; e.g., D1>D2. Non-parallel spacer 20 may be configured, e.g., by machining, or the like, to provide a predetermined amount of non-parallelism between spacer first axial surface 22*a* and spacer second axial surface 22*b*. The amount of non-parallelism between spacer first axial surface 22*a* and spacer second axial surface 22*b* may be predetermined to compensate for a measured amount of unbalance or rot bow of a rotor stack or group (see, for example, FIG. 14A). Non-parallel spacer 20 may have a bore 21 therethrough, e.g., for mounting on threaded portion 26 or smooth body portion 13 of shaft 14.

FIG. 3B is a sectional view of a non-parallel spacer 20', according to another embodiment of the present invention, wherein non-parallel spacer 20' may be generally T-shaped in cross-section. Non-parallel spacer 20' may include a spacer first axial surface 22'*a*, a spacer second axial surface 22'*b*, and a bore 21' for mounting non-parallel spacer 20' on shaft 14. A first width, D3, of non-parallel spacer 20' may be greater than a second width, D4; e.g., D3>D4. Non-parallel spacer 20' may be similarly configured, e.g., by machining, or the like, to provide a predetermined amount of non-parallelism between spacer first axial surface 22'*a* and spacer second axial surface 22'*b*, substantially as described hereinabove with respect to FIG. 3A. Non-parallel spacer 20' may be disposed between a rotor component and an axial surface of nut 16, such that non-parallel spacer 20' may further provide piloting features (see, for example, FIGS. 6A-B).

Non-parallel spacer 20, 20' may be made of any durable material, such as steel or nickel-base superalloys. It should be noted that for some applications, depending on the operating environment, such as temperature and speed, non-parallel spacer 20, 20' may comprise other materials, such a titanium alloys, cobalt-iron alloys, low carbon steels, and the like.

Figure 4B:
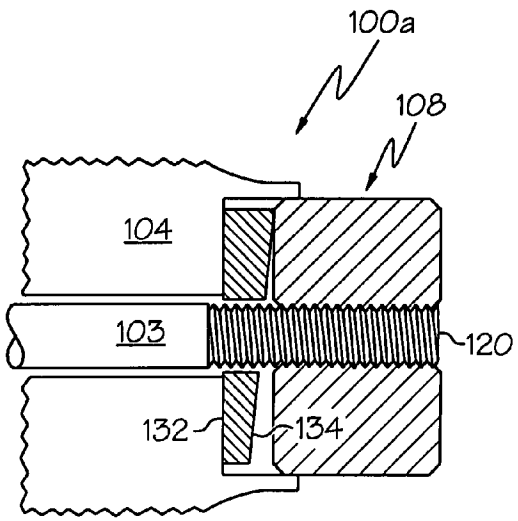
FIG. 4B is an axial sectional view of the rotor assembly of FIG. 4A.
Figure 4A:
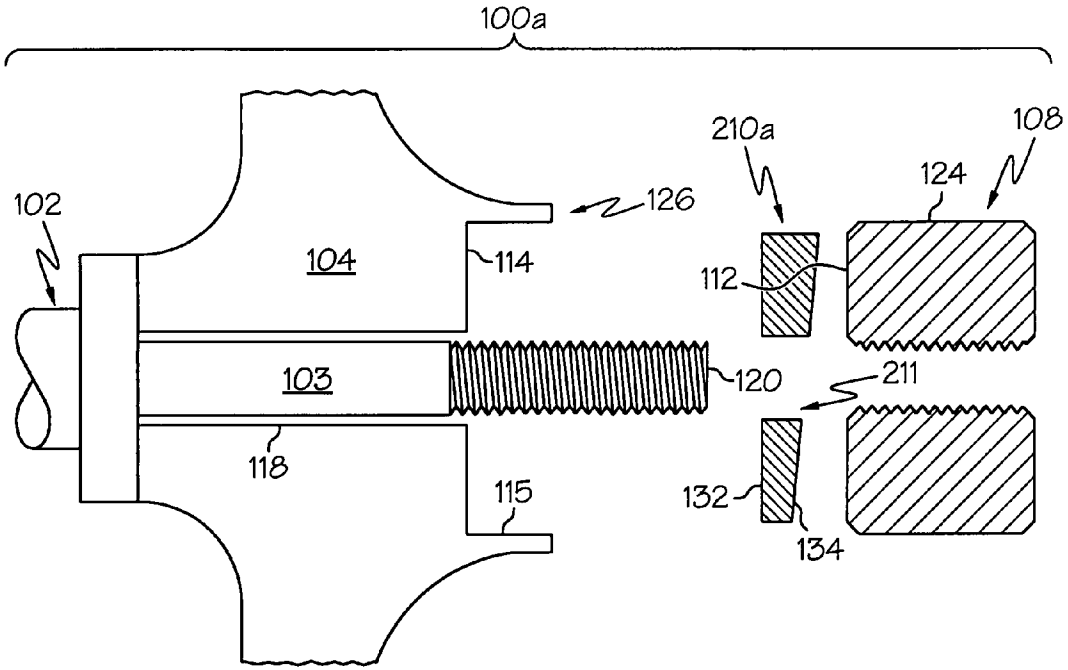
FIG. 4A is an exploded axial sectional view of a rotor assembly including a non-parallel spacer, according to another embodiment of the present invention.

FIG. 4A is an exploded sectional view of a nut end of a rotor assembly 100*a* including a non-parallel spacer 210*a;* and FIG. 4B is a sectional view showing non-parallel spacer 210*a* and nut 108 mounted on shaft 102, according to an embodiment of the present invention. Shaft 102 may have a smooth body portion 103. The embodiment shown in FIGS. 4A-B may further include those elements and features described hereinabove, for example, with reference to FIGS. 1A-B and 2A.

With reference to FIGS. 4A-B, non-parallel spacer 210*a* may be disposed axially between rotor 104 and nut 108. In particular, non-parallel spacer 210*a* may be disposed between rotor axial facing surface 114 of rotor 104 and nut axial mating surface 112 of nut 108. Non-parallel spacer 210*a* may have a spacer first axial surface 132 and a spacer second axial surface 134. Non-parallel spacer 210*a* may be generally in the form of a washer. Spacer first axial surface 132 and spacer second axial surface 134 may be non-parallel surfaces. For example, a pre-determined non-parallelism may exist between spacer first axial surface 132 and spacer second axial surface 134, such that when non-parallel spacer 210*a* is rotated, rotor bow or unbalance of rotor assembly 100*a* may be corrected or compensated for. As a non-limiting example, non-parallel spacer 210*a* may be a disc-shaped structure (see, for example, FIG. 2B) having a bore 211 therethrough for mounting non-parallel spacer 210*a* on shaft 102. Non-parallel spacer 210*a* and nut 108 may be mounted on a nut-receiving, threaded portion 120 of shaft 102.

Spacer first axial surface 132 may mate with rotor axial facing surface 114, and spacer second axial surface 134 may mate with nut axial mating surface 112. Rotor 104, shaft 102, non-parallel spacer 210*a*, and nut 108 may jointly comprise a balance arbor for balancing rotor 104. As will be evident to one skilled in the art, the nut outer diameter, or nut radially outward surface 124 of nut 108 may be piloted by rotor radially inward surface 115 of rotor 104.

Figure 5A:
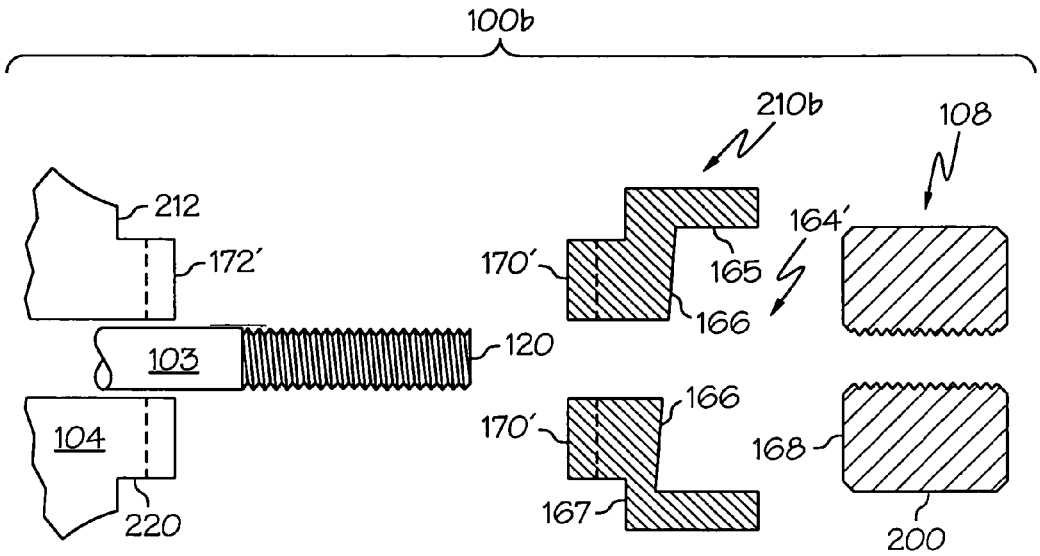
FIG. 5A is an exploded axial sectional view of a rotor assembly, according to another embodiment of the present invention.
Figure 5B:
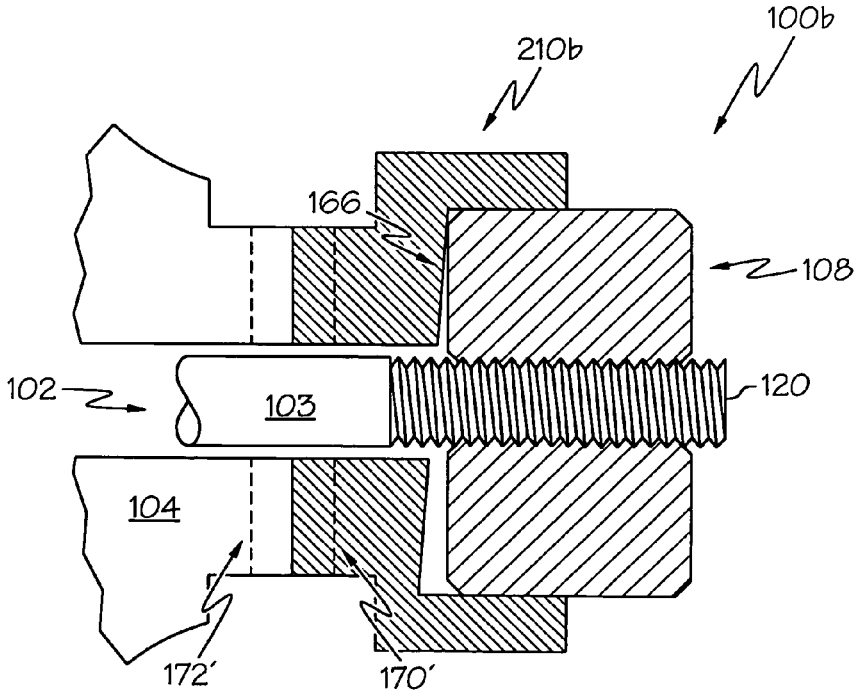
FIG. 5B is an axial sectional view of the rotor assembly of FIG. 5A.

FIG. 5A is an exploded sectional view of a nut end portion of a rotor assembly 100*b*, and FIG. 5B is a sectional view of rotor assembly 100*b* of FIG. 5A, according to another embodiment of the present invention. Rotor assembly 100*b* may comprise a rotor 104, a non-parallel spacer 210*b*, and a nut 108. Rotor 104 may have a rotor axial portion 172', a rotor axial surface 212, and a rotor radially outward surface 220.

With reference to FIGS. 5A-B, non-parallel spacer 210*b* may include a spacer axial portion 170', a spacer radially inward surface 165, a spacer first axial surface 166, and a spacer second axial surface 167. Spacer first axial mating surface 166 of non-parallel spacer 210*b* may have a predetermined non-parallel relationship to spacer axial portion 170' such that non-parallel spacer 210*b* may compensate for rotor bow or unbalance that may be intrinsic to rotor assembly 100*b*. Thus, non-parallelism of spacer 210*b* may be pre-determined such that non-parallel spacer 210*b* may correct for non-parallelism of one or more other rotor components, thereby reducing or eliminating rotor bow (see, e.g., FIGS. 1B, 2A).

Rotor axial portion 172' may mate with spacer axial portion 170'. Spacer axial portion 170' may comprise a spacer axial and radial piloting feature compatible with rotor axial portion 172.' Rotor axial portion 172' may comprise a curvic coupling, a rabbit coupling, a radial spline, or other suitable rotor piloting feature well known in the art, which may provide both radial and axial piloting features. Spacer first axial surface 166 may mate with a nut axial mating surface 168 of nut 108. Spacer radially inward surface 165 may define a spacer bore 164' of non-parallel spacer 210*b*. Spacer radially inward surface 165 may surround, and mate with, a nut outer diameter or nut radially outward surface 200 of nut 108.

Figure 6B:
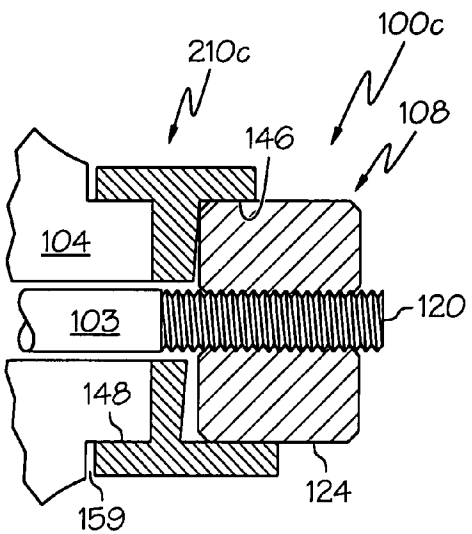
FIG. 6B is an axial sectional view of the rotor assembly of FIG. 6A.
Figure 6A:
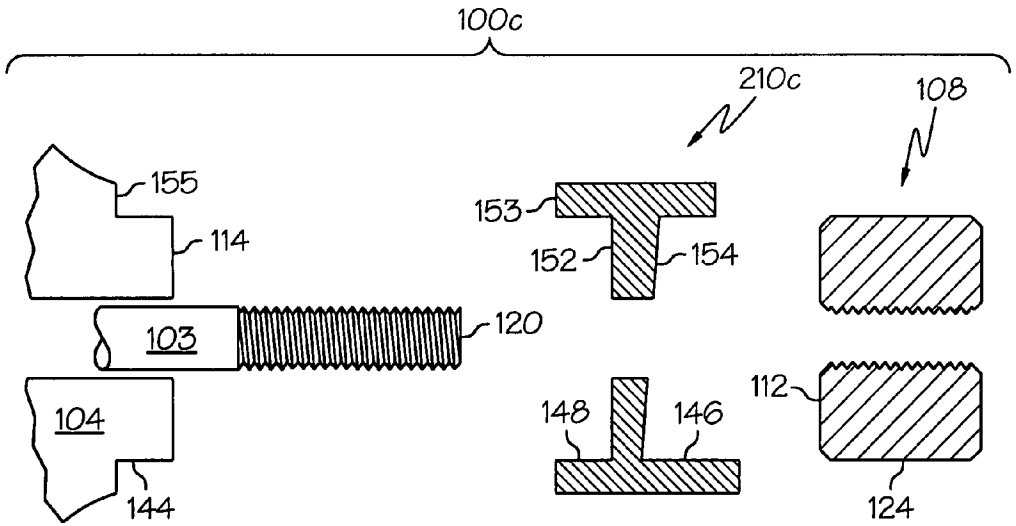
FIG. 6A is an exploded axial sectional view of a rotor assembly, according to another embodiment of the present invention.

FIG. 6A is an exploded sectional view of a nut end portion of a rotor assembly 100*c* having a non-parallel spacer 210*c*, according to another embodiment of the present invention. Non-parallel spacer 210*c* may serve as a nut piloting insert. Non-parallel spacer 210*c* may be generally T-shaped in cross-section. FIG. 6B is a sectional view of rotor assembly 100*c* showing nut 108 mounted on shaft threaded portion 120, with non-parallel spacer 210*c* disposed axially between rotor 104 and nut 108. Rotor 104 may include a rotor first axial surface 114, a rotor second axial surface 155, and a rotor radially outward surface 144.

With further reference to FIGS. 6A-B, non-parallel spacer 210*c* may include a spacer first radially inward surface 148, a spacer second radially inward surface 146, a spacer first axial surface 152, a spacer second axial surface 154, and a spacer third axial surface 153. Spacer first axial surface 152 may mate with rotor first axial surface 114. Spacer second axial surface 154 may mate with a nut axial mating surface 112 of nut 108. Spacer first axial surface 152 and second axial surface 154 may be non-parallel to each other by a pre-defined amount. Spacer third axial surface 153 may form a gap with rotor second axial surface 155. Non-parallel spacer 210*c* may be rotated on shaft 102 with respect to components of rotor assembly 100*c*, such as rotor 104, to correct for rotor bow of shaft 102.

Figure 7A:
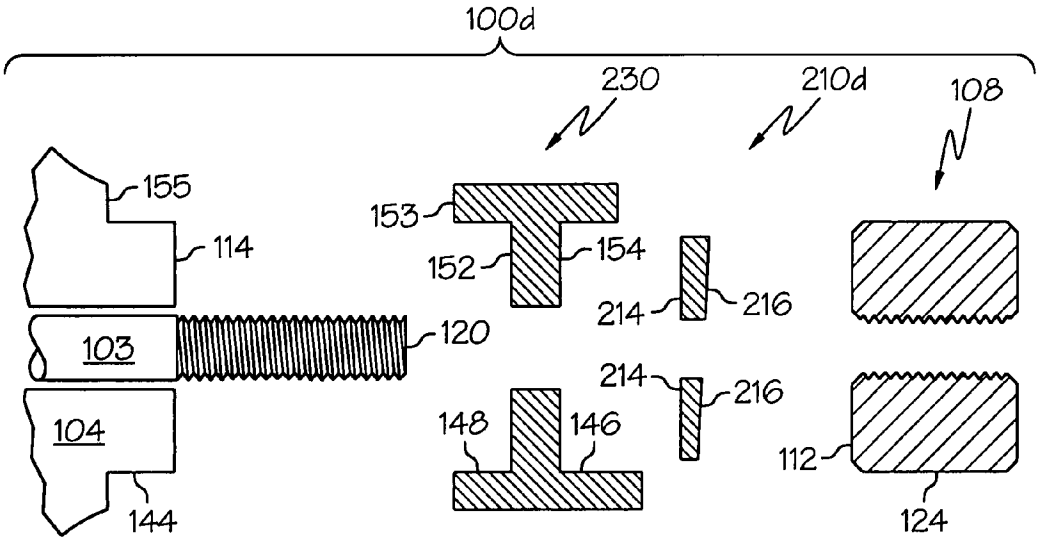
FIG. 7A is an exploded axial sectional view of a rotor assembly, according to another embodiment of the present invention.
Figure 7B:
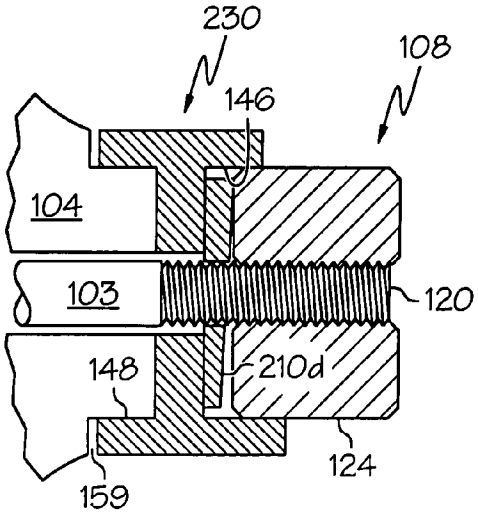
FIG. 7B is an axial sectional view of the rotor assembly of FIG. 7A.

FIG. 7A is an exploded sectional view of a nut end portion of a rotor assembly 100*d* having a nut spacer 230 and FIG. 7B is an axial sectional view of the rotor assembly of FIG. 7A, according to another embodiment of the present invention. Rotor 104 may include a rotor first axial surface 114, a rotor second axial surface 155, and a rotor radially outward surface 144. Nut spacer 230 may serve as a nut piloting insert. Nut spacer 230 may be generally T-shaped in cross-section. A non-parallel spacer 210*d* may be disposed between nut spacer 230 and nut 108. Non-parallel spacer 210*d* may have a first axial surface 214 and a second axial surface 216, wherein first axial surface 214 and second axial surface 216 may be non-parallel to each other. Furthermore, non-parallel spacer 210*d* may have a pre-determined non-parallelism with respect to first axial surface 214 and second axial surface 216, such that an intrinsic unbalance of a plurality of rotor components, e.g., on rotor assembly 100*d* may be compensated for by non-parallel spacer 210*d*. For example, when non-parallel spacer 210*d* is rotated, rotor bow of rotor assembly 100*d* may be corrected (rotor bow is not shown in FIGS. 7A-B; see, e.g., FIGS. 1B and 2A). As may be seen from FIG. 7B, an axial gap 159 may exist between nut spacer 230 and rotor second axial surface 155.

Figure 8A:
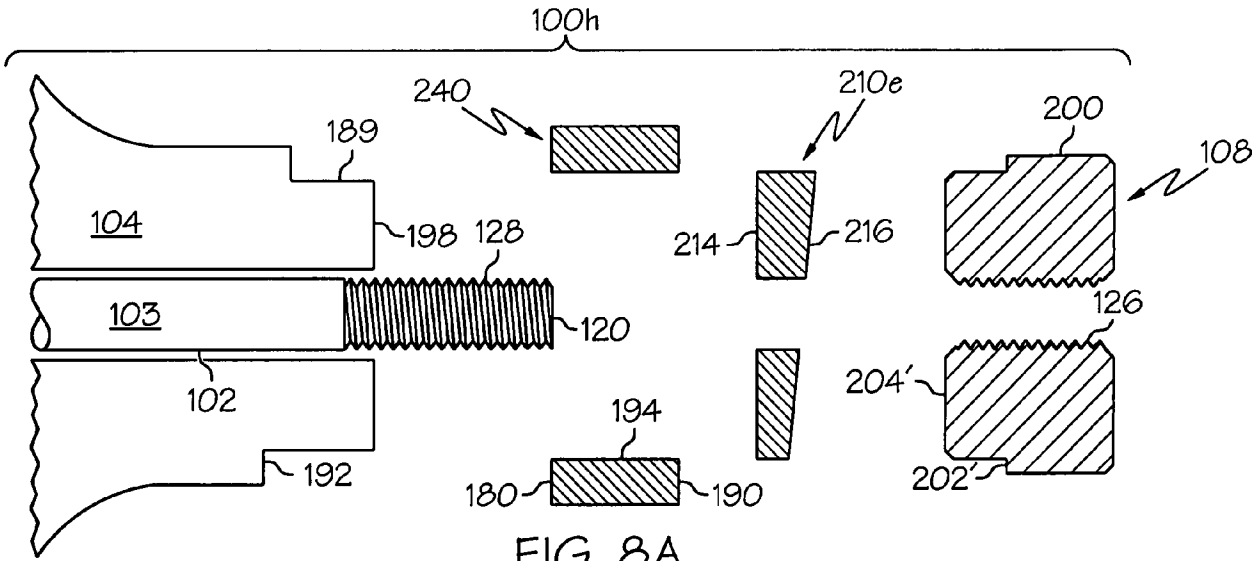
FIG. 8A is an exploded axial sectional view of a rotor assembly, according to another embodiment of the present invention.
Figure 8B:
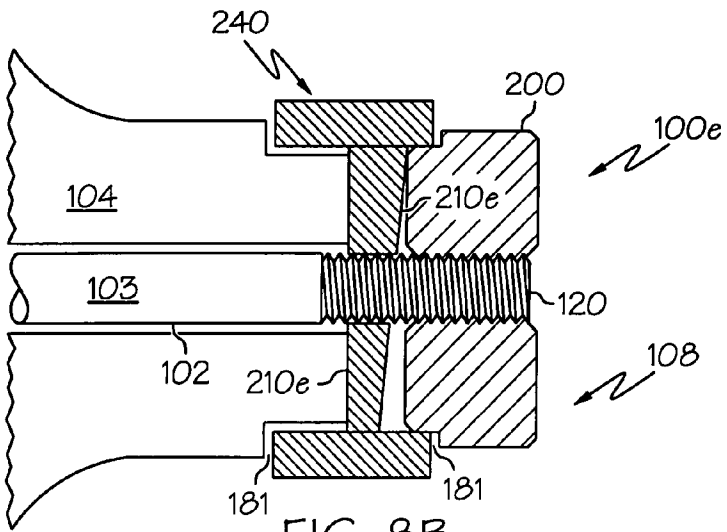
FIG. 8B is an axial sectional view of the rotor assembly of FIG. 8A.

With reference to FIGS. 8A-B, a rotor assembly 100*e*, piloting on an axially floating ring 240, according to another embodiment of the present invention, may comprise a rotor 104, a nut 108, and floating ring 240, wherein nut 108 may be substantially L-shaped in cross-section. Rotor 104 may include a rotor axial facing surface 192, a rotor axial mating surface 198, and a rotor radially outward mating surface 189.

With further reference to FIGS. 8A-B, a non-parallel spacer 210*e* may be disposed at least substantially axially between nut 108 and rotor 104. Non-parallel spacer 210*e* may have a first axial surface 214 and a second axial surface 216, wherein first axial surface 214 and second axial surface 216 may be non-parallel to each other, such that when rotated and loaded by nut 108, non-parallel spacer 210*e* may correct for rotor bow of rotor assembly 100*e*.

Floating ring 240 may have a ring first axial surface 180, a ring second axial surface 190, and a ring radially inward surface 194. Non-parallel spacer 210*e* may be radially piloted by ring radially inward surface 194 of floating ring 240. Nut 108 may include a nut axial facing surface 202' and a nut axial mating surface 204'. As seen in FIG. 8B, an axial gap 181 may exist on each side of floating ring 240, namely between rotor axial facing surface 192 and ring first axial surface 180, and between ring second axial surface 190 and nut axial facing surface 202'.

Figure 9:
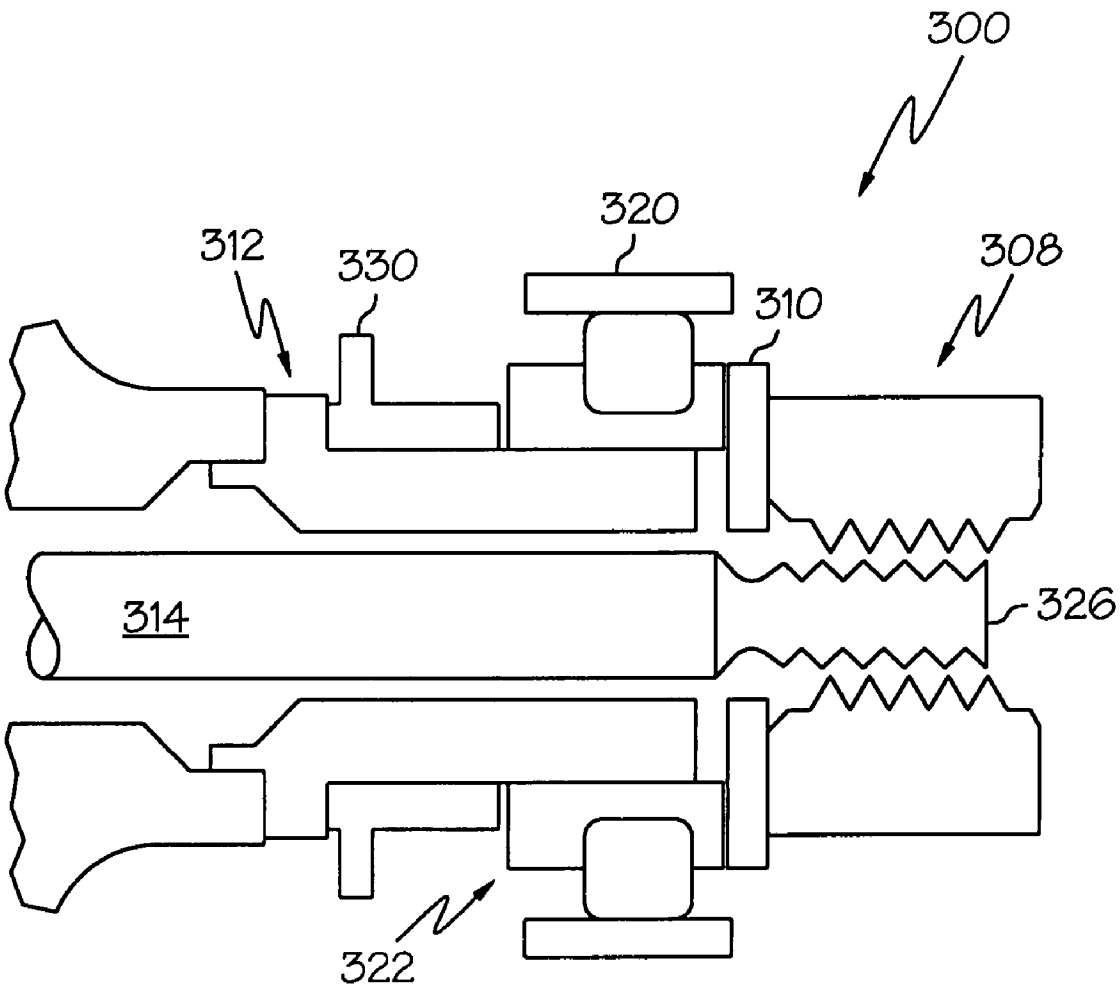
FIG. 9 is an axial sectional view of an axially loaded component stack including a non-parallel spacer axially loaded between a bearing inner race and a nut, according to another embodiment of the present invention.

FIG. 9 is an axial sectional view of a nut end of a rotor assembly 300, according to another embodiment of the present invention. Rotor assembly 300 may have elements and features analogous to those described hereinabove, e.g., with reference to FIG. 1A. Thus, rotor assembly 300 may comprise a shaft 314 and a plurality of rotor components mounted coaxial to shaft 314. Rotor assembly 300 may further include a proximal rotor component 312 mounted coaxial to shaft 314, and in some embodiments, may be mounted on shaft 314. Rotor assembly 300 may further comprise a proximal roller bearing 320, including an inner race 322.

Rotor assembly 300 may still further comprise a non-parallel spacer 310, wherein non-parallel spacer 310 may be axially disposed between inner race 322 and nut 308. Nut 308 may be disposed on a proximal threaded portion 326 of shaft 314. A seal rotor 330 may be disposed radially outward from rotor component 312. Non-parallel spacer 310 may include a distal first axial surface and a proximal second axial surface (see, for example, FIGS. 3A-B). Non-parallel spacer 310 may have a pre-determined amount of non-parallelism between the spacer first axial surface and the spacer second axial surface, so as to compensate for rotor bow or unbalance of rotor assembly 300. The spacer first axial surface may contact inner race 322, while the spacer second axial surface may contact a nut axial mating surface of nut 308, such that nut load may be applied to inner race 322 via non-parallel spacer 310.

Figure 10:
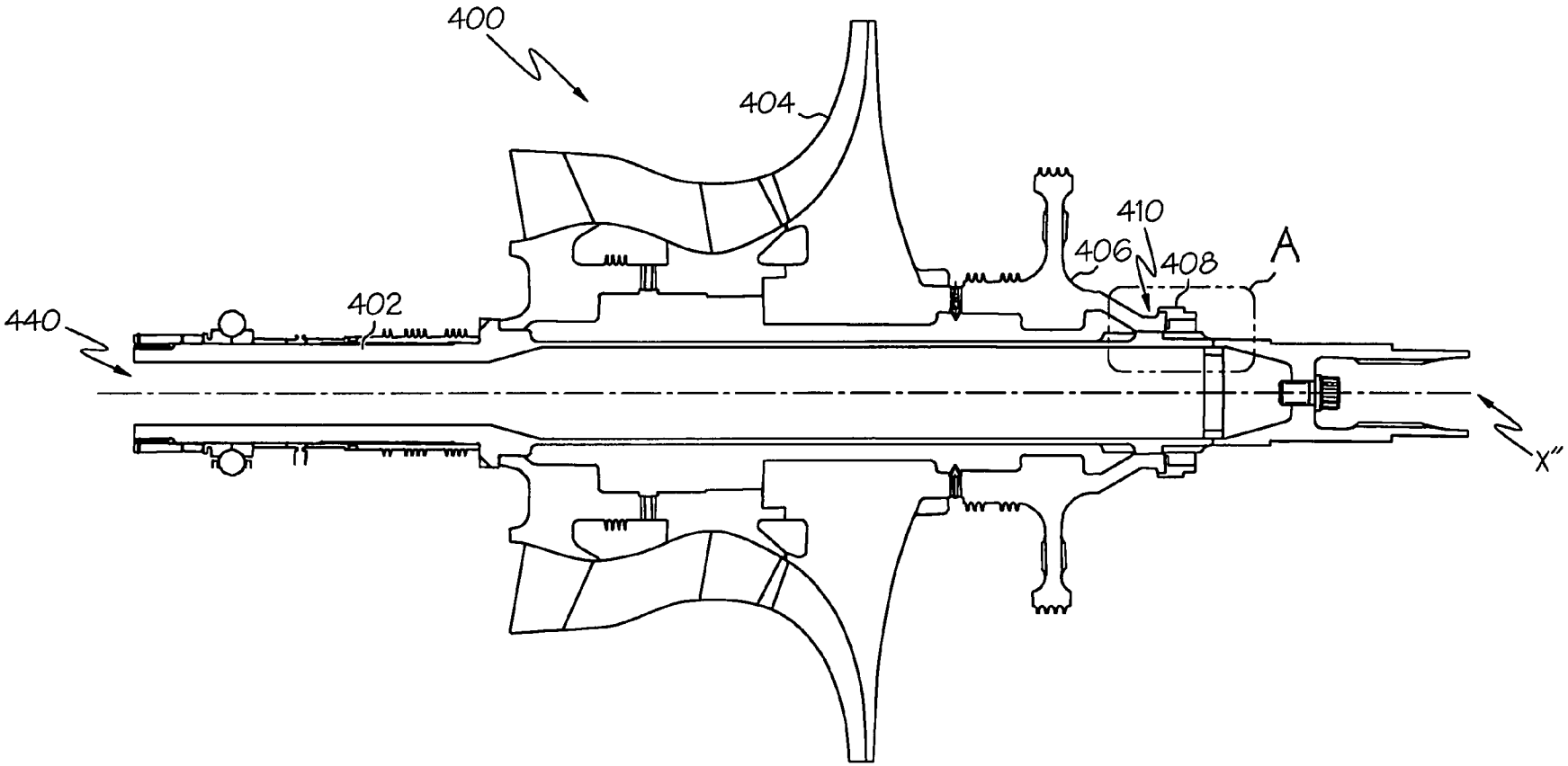
FIG. 10 is a cross sectional view of a component stack, according to another embodiment of the present invention.

With reference to FIG. 10, in another embodiment of the present invention there is provided a rotor assembly or rotating component stack 400, comprising a rotor group 404. Rotor group 404 may have a shaft receiving bore 440 axially defined therein. A shaft 402 may be coaxial with the rotor group 404, with respect to axis X". Component stack 400 may further comprise a nut 408 for rotationally connecting shaft 402 with components which may include rotor group 404 and a thrust piston 406. Each of rotor stack 404, thrust piston 406; and nut 408 may be secured in fixed relation to each other. Thrust piston 406 may be disposed between rotor group 404 and nut 408. Nut 408 may comprise, as non-limiting examples, steel alloys, such as 4340 or A286, or a nickel-based superalloy, such as Inco 718™.

With reference to FIGS. 10 and 11A-13B, in some embodiments of the present invention, a T-spacer 412 (see, e.g., FIGS. 11A-13A) may be disposed axially between thrust piston 406 and nut 408. T-spacer 412 may serve as a nut piloting insert, e.g., for piloting the outer diameter of nut 408. A non-parallel spacer 450 (see, FIGS. 12A-B) may be mounted between nut 408 and any component of component stack 400, such as thrust piston 406. As a non-limiting example, non-parallel spacer 450 may be mounted between T-spacer 412 and a foot 410 (see, FIG. 10) of thrust piston 406.

Figure 11B:
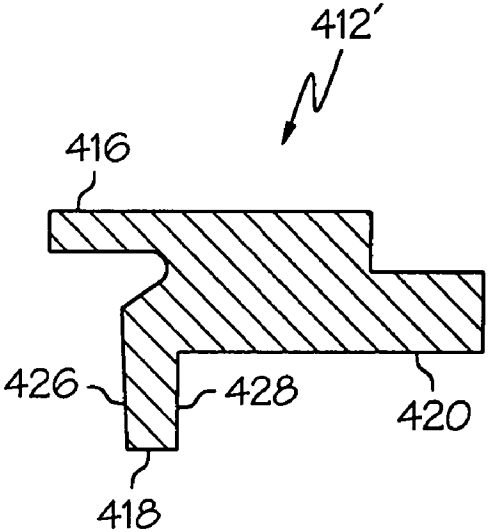
FIG. 11B is a side view of the non-parallel T-spacer of FIG. 11A.
Figure 11A:
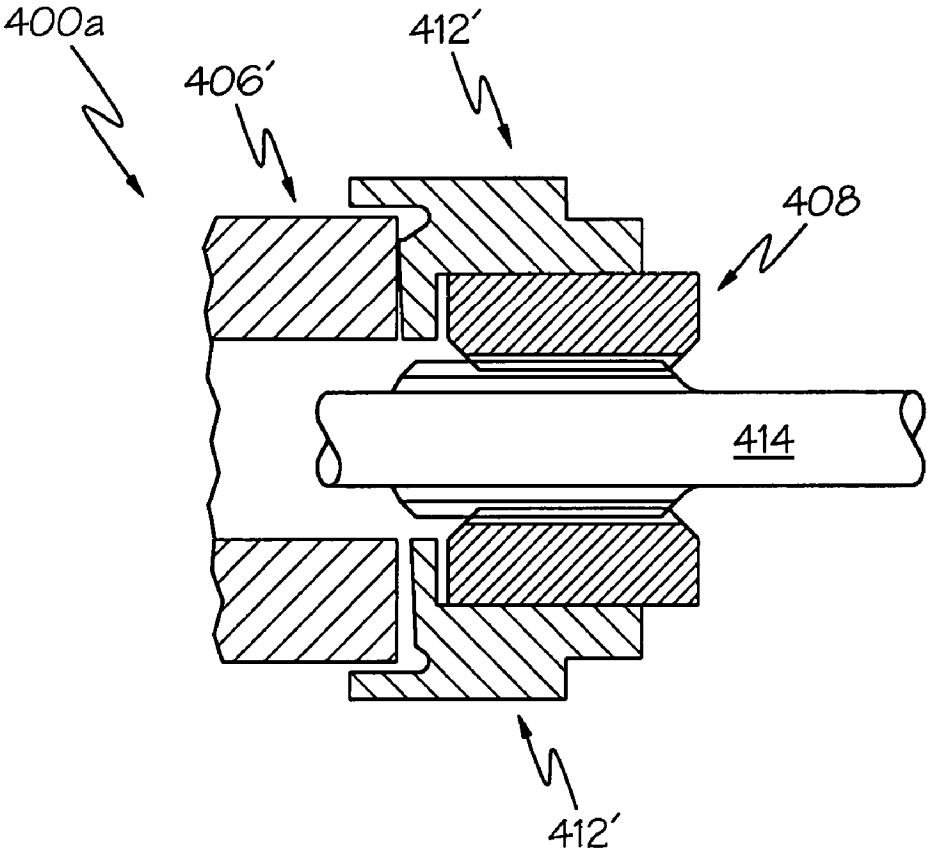
FIG. 11A is an expanded sectional view of Area A of FIG. 10 showing a non-parallel T-spacer disposed between a rotor component and a nut, according to another embodiment of the present invention.

FIG. 11A is an expanded sectional view of Area A of FIG. 10 showing a nut end of a rotor assembly 400*a*, including a non-parallel T-spacer 412', according to another embodiment of the present invention. Non-parallel T-spacer 412' may have non-parallel axial surfaces. FIG. 11B is a side view showing non-parallel T-spacer 412' of FIG. 11A.

With reference to FIGS. 11A-B, non-parallel T-spacer 412' may be disposed between a rotor component 406' and a nut 408. Rotor component 406' may comprise a thrust piston, as described with reference to FIG. 10, or the like. Non-parallel T-spacer 412' may include a first arm 416, a second arm 418, and a radially inward nut-facing surface 420. Second arm 418 may include a second arm distal axial surface 426 and a second arm proximal axial surface 428. Non-parallel T-spacer 412' may have a specified or pre-determined non-parallelism between second arm distal axial surface 426 and second arm proximal axial surface 428. Non-parallel T-spacer 412' may serve both as a non-parallel spacer for correcting rotor bow or unbalance, as well as for piloting of nut 408, e.g., via radially inward nut-facing surface 420 and/or second arm proximal axial surface 428.

Figure 12B:
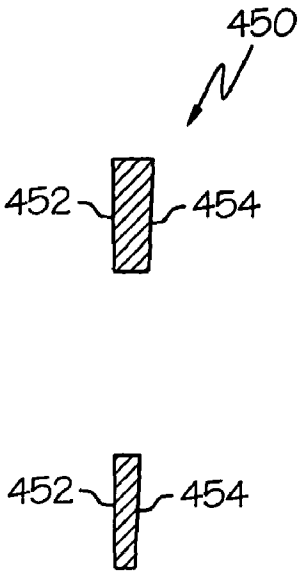
FIG. 12B is a side view of the non-parallel spacer of FIG. 12A.
Figure 12A:
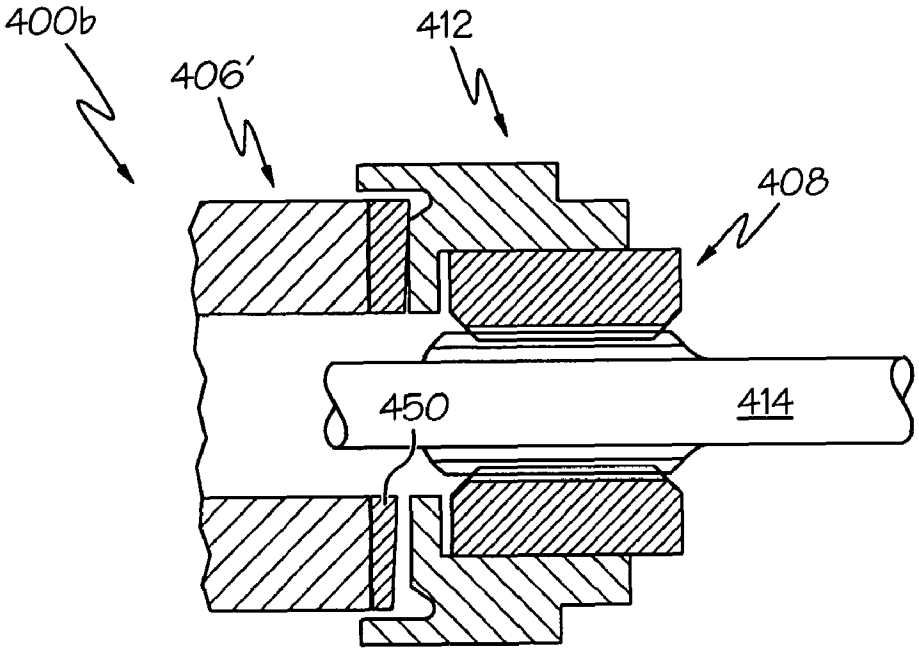
FIG. 12A is an expanded sectional view of Area A of FIG. 10 showing a non-parallel spacer disposed between a rotor component and a T-spacer, according to another embodiment of the present invention.

FIG. 12A is an expanded sectional view of Area A of FIG. 10 showing a nut end of a rotor assembly 400*b*, including a non-parallel spacer 450, and a T-spacer 412, according to another embodiment of the present invention. FIG. 12B is a side view of non-parallel spacer 450 of FIG. 12A.

With reference to FIGS. 12A-B, T-spacer 412 may be disposed between a rotor component 406' and a nut 408. Rotor component 406' may comprise a thrust piston, as described with reference to FIG. 10, or the like. T-spacer 412 may include elements and features as described for non-parallel T-spacer 412' of FIGS. 11A-B. For example, T-spacer 412 may have pre-determined non-parallelism between second arm distal axial surface 426 and second arm proximal axial surface 428 (see, FIGS. 11A-B), or in alternative embodiments, T-spacer 412 may have at least substantially parallel axial sides. Non-parallel spacer 450 may serve to correct for rotor bow or unbalance of rotor assembly 400*b*. Non-parallel spacer 450 may include a spacer first axial surface 452 and a spacer second axial surface 454. Non-parallel spacer 450 may be configured to provide a predetermined amount of non-parallelism. Non-parallel spacer 450 may also have elements and features as described hereinabove, e.g., with reference to FIG. 3A. In the case where T-spacer 412 may also have a predetermined non-parallelism, both non-parallel spacer 450 and T-spacer 412 can be rotated to correct for rotor bow or unbalance of rotor assembly 400*b*.

Figure 13B:
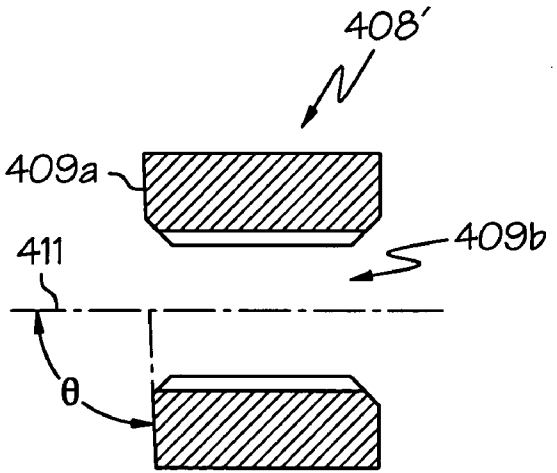
FIG. 13B is a side view of the non-parallel nut of FIG. 13A.
Figure 13A:
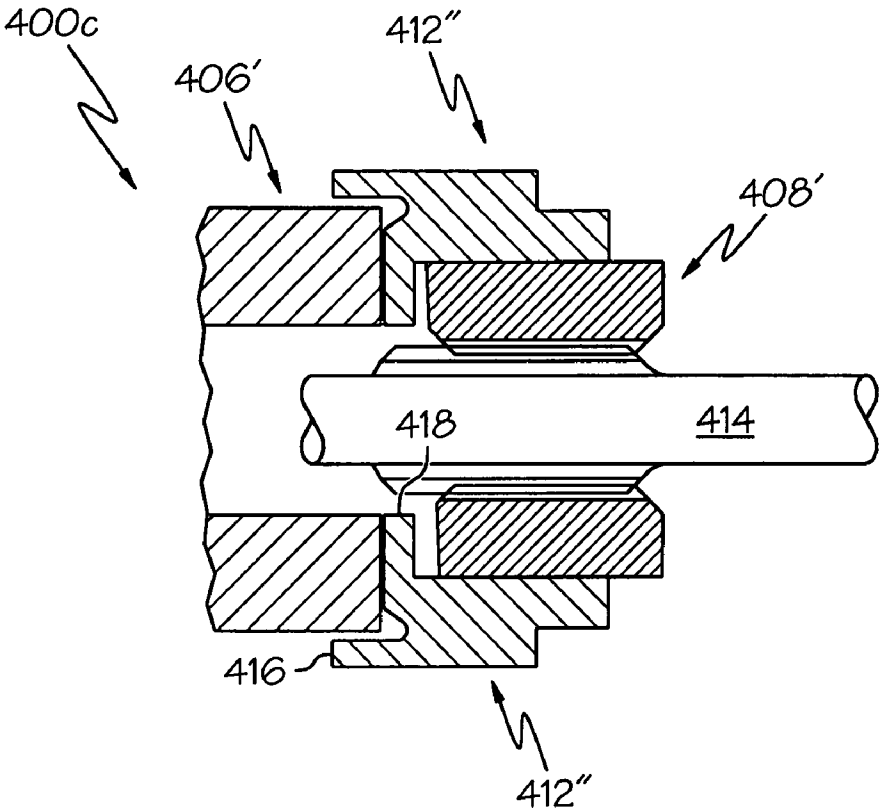
FIG. 13A is an expanded sectional view of Area A of FIG. 10 showing a T-spacer disposed between a rotor component and a non-parallel nut, according to another embodiment of the present invention.

FIG. 13A is an expanded sectional view of Area A of FIG. 10 showing a nut end of a rotor assembly 400*c* including a T-spacer 412", and a non-parallel nut 408', according to another embodiment of the present invention. FIG. 13B is a side view of non-parallel nut 408' of FIG. 13A.

With reference to FIGS. 13A-B, T-spacer 412" may include a first arm 416 and a second arm 418. Second arm 418 of T-spacer 412" may be axially disposed between a rotor component 406' and non-parallel nut 408'. Rotor component 406' may comprise a thrust piston, as described with reference to FIG. 10, or the like. T-spacer 412" may include other elements and features as described for non-parallel T-spacer 412' of FIGS. 11A-B and T-spacer 412 of FIGS. 12A-B. For example, non-parallel T-spacer 412" may have pre-determined non-parallelism between a second arm distal axial surface and a second arm proximal axial surface (see, e.g., FIGS. 11A-B). Non-parallel nut 408' may have pre-determined non-parallelism. For example, nut 408' may have a nut axis 411 and a nut distal axial surface 409*a* disposed non-orthogonal to nut axis 411, wherein nut distal axial surface 409*a* may be disposed at a pre-determined angle e to nut axis 411, wherein angle θ is ≠90°. This may often be referred to as a predetermined amount of runout of axial face 409*a* to thread pitch diameter 409*b*. Accordingly, in the embodiment of FIGS. 13A-B, non-parallel nut 408' may serve both for axial loading, and to correct for rotor bow or unbalance, of rotor assembly 400*c*. In addition, non-parallel T-spacer 412'/412" may function in concert with non-parallel nut 408' to correct for rotor bow or unbalance of rotor assembly 400*c*.

Figure 14A:
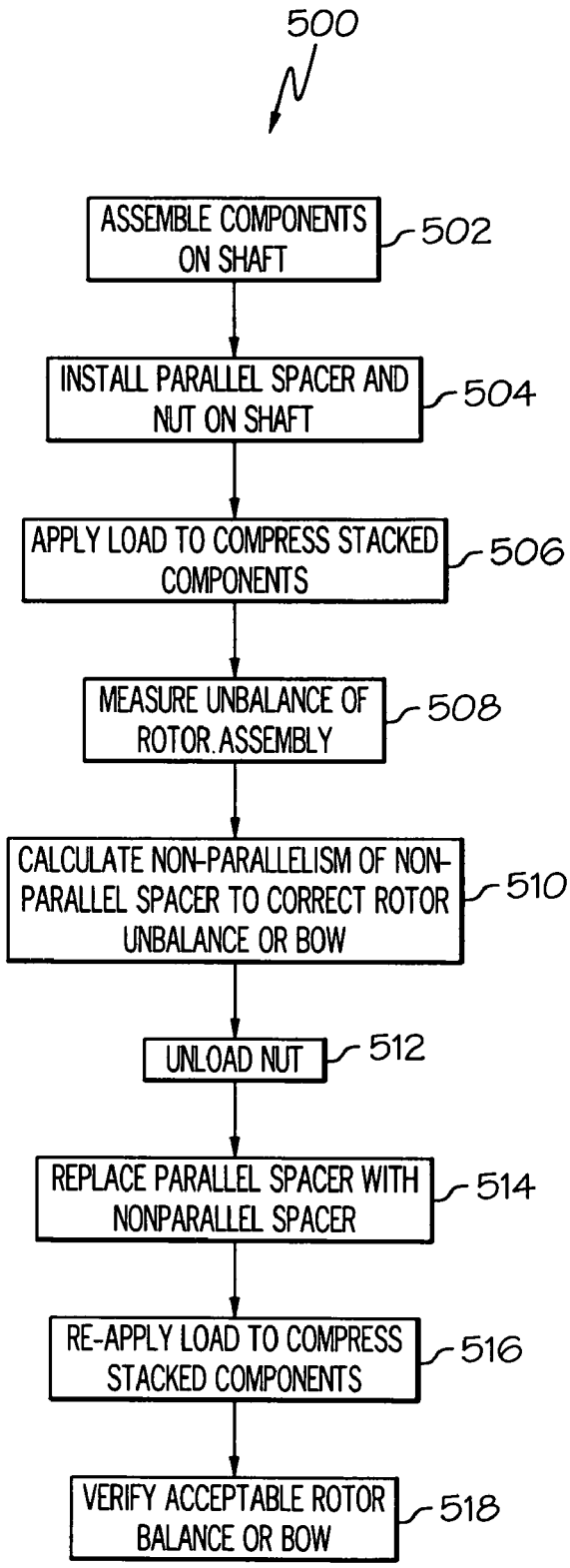
FIG. 14A is a flow chart of a method for balancing a group of rotating components, according to another embodiment of the present invention.

With reference to FIG. 14A, a method 500 for balancing a group of rotating components may comprise a step 502 which may involve assembling at least one rotor component on a shaft of a rotor assembly to provide a component stack. The shaft may comprise a tie-shaft which may be inserted in a receiving bore within the component stack. Thereafter, step 504 may involve installing a parallel spacer and a nut on the shaft of the rotor assembly, wherein the parallel spacer may be of a pre-defined thickness. In some embodiments, the parallel spacer may be installed on a threaded proximal end of the shaft adjacent to the nut.

Step 506 may involve applying a load to the nut to axially load the component stack. During step 506, the component stack may be compressed, and the rotor assembly may be bowed, e.g., due to one or more non-parallel components of the component stack. According to an embodiment of the present invention, the apparatus provided as a result of step 506 may be referred to as a pre-balanced rotor assembly. Step 508 may involve measuring the degree or amount of rotor bow and/or unbalance of the pre-balanced rotor assembly. Techniques for measuring rotor bow of stacked rotor components are well known in the art.

Step 510 may involve calculating the configuration of a non-parallel spacer required to correct for the rotor bow and/or unbalance measured in step 508. Thus, step 510 may involve determining a degree of non-parallelism of the non-parallel spacer sufficient to compensate for the unbalance or bow of the step 508.

Step 512 may involve unloading the nut, whereby the component stack may be relaxed. Step 514 may involve replacing the parallel spacer (of step 504) with the pre-determined non-parallel spacer as defined or determined in step 510. In some embodiments, the non-parallel spacer may be installed on the shaft adjacent to the nut, i.e., at the end of the nut end of the shaft between the nut and a terminal component of the component stack (see, e.g., FIG. 2A). In other embodiments, one or more non-parallel spacers, each having a pre-determined non-parallelism, may be installed on the shaft between adjacent rotor components of the rotor assembly (see, e.g., FIG. 2B). The non-parallel spacer may have non-parallel axial sides and other features, for example, as described with reference to FIGS. 3A-B. As non-limiting examples, the non-parallel spacer installed on the shaft in step 514 may have a T-shaped cross-sectional shape or may be in the form generally of a non-parallel washer (i.e., the non-parallel spacer may be substantially disc-shaped).

After step 514, an axial load may again be applied via the nut (step 516) to axially load the stack of components. Thereafter, rotor balance and/or bow acceptability may be verified in step 518.

Figure 14B:
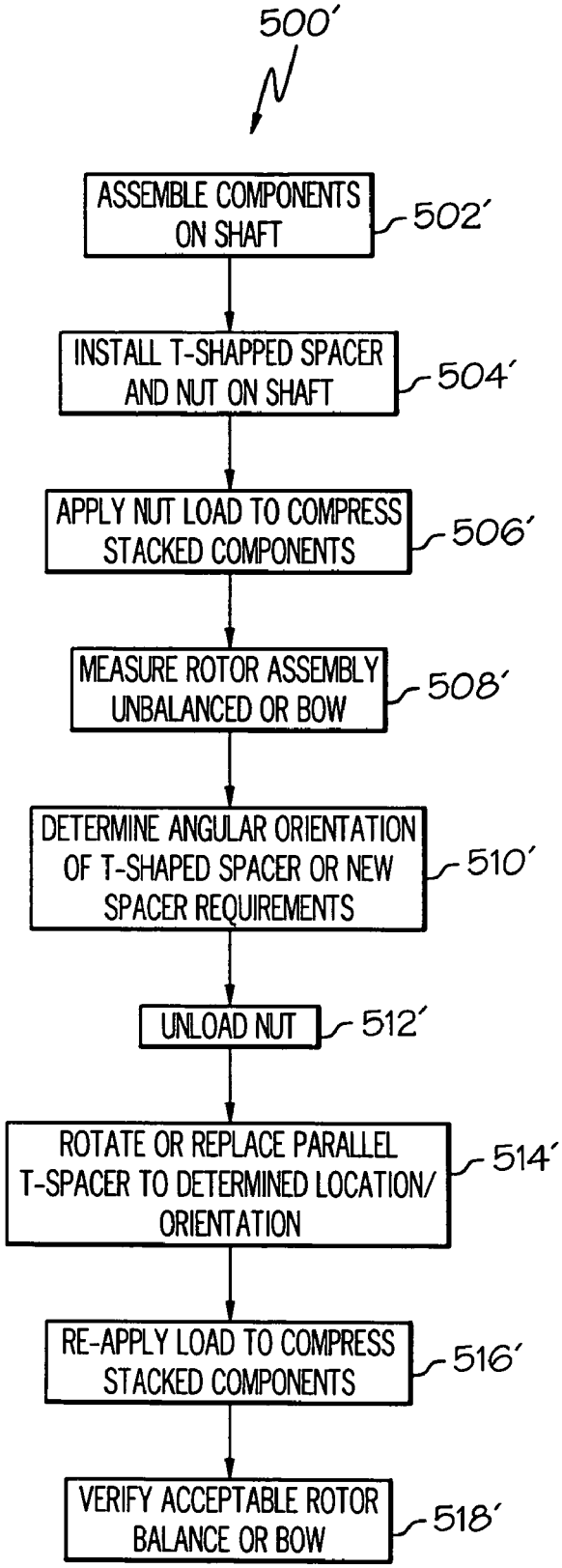
FIG. 14B is a flow chart of a method for balancing a group of rotating components, according to another embodiment of the present invention.

With respect to FIG. 14B, a method 500' for correcting rotor bow in a group of rotor components, or component stack, may comprise a step 502' of assembling at least one rotor component on a shaft of a rotor assembly, essentially as described hereinabove for step 502 of method 500 (FIG. 14A). Thereafter, step 504' may involve installing a T-shaped spacer and a nut on the shaft of the rotor assembly.

Steps 506' may involve applying a load to the nut to axially load the component stack, and step 508' may involve measuring the amount of rotor bow and/or unbalance of the pre-balanced rotor assembly, substantially as described hereinabove with reference to FIG. 14A for steps 506 and 508, respectively.

Step 510' may involve determining a correct angular orientation of the T-spacer with respect to the shaft. In some embodiments, step 510' may alternatively or additionally involve determining any further spacer requirements which may be required to correct for the amount of rotor bow and/or unbalance of the pre-balanced rotor assembly as determined in step 508'. Step 512' may involve unloading the nut, substantially as described hereinabove for step 512 of method 500 (FIG. 14A). Step 514' may involve rotating the T-shaped spacer (of step 504') on the shaft, or replacing the spacer with a replacement spacer, as determined in step 510'.

Thereafter, an axial load may again be applied via the nut (step 516') to axially load the component stack; and rotor balance and/or bow acceptability may be verified (step 518'), substantially as described hereinabove for steps 516 and 518 of method 500 (FIG. 14A).

It should be understood, of course, that the foregoing relates to exemplary embodiments of the invention and that modifications may be made without departing from the spirit and scope of the invention as set forth in the following claims.

We claim:

1. A rotor assembly, comprising:

a shaft;

at least one rotor disposed on said shaft;

a nut for axially loading said at least one rotor on said shaft, said shaft having a threaded portion for receiving said nut; and a non-parallel spacer disposed between said nut and said at least one rotor, said non-parallel spacer configured for at least one of radial piloting and axial piloting of said at least one rotor, said non-parallel spacer having a curvic, rabbit, or radial spline piloting feature for said at least one of radial piloting and axial piloting.

2. The rotor assembly of claim 1, wherein: said non-parallel spacer includes a spacer first axial surface and a spacer second axial surface; and said non-parallel spacer has a predetermined amount of non-parallelism between said spacer first axial surface and said spacer second axial surface.

3. The rotor assembly of claim 2, wherein said non-parallel spacer is configured for correcting rotor bow or unbalance of said rotor assembly.

4. The rotor assembly of claim 1, wherein said at least one rotor comprises a plurality of stacked rotor components.

5. The rotor assembly of claim 4, wherein said plurality of stacked rotor components include a thrust piston.

6. The rotor assembly of claim 1, wherein said nut and said non-parallel spacer each comprise a material selected from the group consisting of an alloy of iron, steel, nickel, cobalt, titanium, and aluminum.

7. The rotor assembly of claim 1, wherein:

said at least one rotor includes a shaft-receiving bore axially defined therein;

said shaft is disposed within said shaft-receiving bore;

said at least one rotor further includes a rotor radially outward surface and a rotor axial facing surface;

said nut is configured for rotationally coupling said at least one rotor to said shaft;

said shaft having a threaded portion for receiving said nut; and said non-parallel spacer has a predetermined amount of non-parallelism between a spacer first axial surface and a spacer second axial surface.

8. The rotor assembly of claim 7, wherein said non-parallel spacer has a T-shaped cross-section.

9. The rotor assembly of claim 8, wherein:

said nut includes a nut radially oriented mating surface and a nut axial mating surface;

said non-parallel spacer includes a spacer radially outward surface, a spacer first axial surface, and a spacer second axial surface;

said rotor axially facing surface is loaded against said spacer first axial surface of said non-parallel spacer and said nut axial mating surface is loaded against a second axial surface of said non-parallel spacer; and said rotor radially outward surface mates with said spacer radially outward surface.

10. The rotor assembly of claim 7, wherein:

said at least one rotor comprises a plurality of stacked rotor components;

said plurality of stacked rotor components comprises at least one non-parallel component; and said non-parallel spacer is configured to compensate for said at least one non-parallel component for correction of rotor bow of said rotor assembly.

11. The rotor assembly of claim 7, wherein:

said shaft is supported by a bearing having an inner race, said spacer first axial surface contacts said inner race, said spacer second axial surface contacts a nut axial surface of said nut, and nut load is applied to said inner race via said non-parallel spacer.

12. A rotating component stack for a turbine system, comprising:

a rotor stack including a shaft-receiving bore axially defined therein;

a tie-shaft disposed within said shaft-receiving bore;

a nut for axially loading said rotor stack and said tie-shaft, said rotor stack and said nut having a common axis and fixed in relation to each other;

said nut having a nut axial facing surface and a nut axial mating surface;

a non-parallel spacer disposed axially between said nut and said rotor, said non-parallel spacer configured for correcting rotor bow of said rotor stack; and a floating ring disposed radially outward from said non-parallel spacer, said floating ring configured for piloting said nut.

13. The rotating component stack of claim 12, wherein:

said non-parallel spacer has a predetermined amount of non-parallelism between a spacer first axial surface and a spacer second axial surface, and said non-parallel spacer is configured to compensate for intrinsic unbalance of said rotor group so as to provide balance to said rotating component stack.

14. The rotating component stack of claim 12, wherein:

said rotor stack includes a rotor radially outward mating surface and a rotor axial facing surface;

said floating ring is disposed on said rotor radially outward mating surface;

said non-parallel spacer includes a spacer first axial facing surface and a spacer second axial facing surface;

said floating ring includes a ring first axial surface and a ring second axial surface;

said spacer first axial facing surface contacts said rotor axial facing surface;

said spacer second axial facing surface contacts said nut first axial facing surface;

a first axial gap exists between said rotor axial facing surface and said ring first axial surface;

a second axial gap exists between said ring second axial surface and said nut axial facing surface; and said floating ring is configured for piloting said nut to said rotor stack.

15. The rotating component stack of claim 12, wherein said nut and said non-parallel spacer each comprise a material selected from the group consisting of an iron alloy, steel alloy, nickel alloy, cobalt alloy, titanium alloy, and aluminum alloy.

16. A rotor assembly, comprising:

a shaft having a proximal threaded portion;

a plurality of rotor components stacked on said shaft;

a nut disposed on said proximal threaded portion of said shaft; and a T-spacer disposed on said shaft, wherein:

said T-spacer is disposed between said nut and one of said plurality of rotor components; and at least one of said T-spacer and said nut has non-parallel axial surfaces.

17. The rotor assembly of claim 16, wherein:

said T-spacer includes an axial first arm and a second arm orthogonal to said first arm, said second arm includes a first axial surface and a second axial surface, and a pre-determined non-parallelism exists between said first axial surface and said second axial surface.

18. The rotor assembly of claim 17, further comprising a non-parallel spacer disposed on said shaft, wherein:

said non-parallel spacer is axially disposed between said second arm of said T-spacer and said one of said plurality of rotor components; and said second arm of said T-spacer is axially disposed between said non-parallel spacer and said nut.

19. The rotor assembly of claim 18, wherein said nut and said non-parallel spacer each comprise a material selected from the group consisting of an iron alloy, a steel alloy, a nickel alloy, a cobalt alloy, a titanium alloy and an aluminum alloy.

20. A method for correcting rotor bow for a rotor group stacked on a shaft, said rotor group including a plurality of rotor components, comprising:

a) mounting a non-parallel spacer between two adjacent components of said plurality of components, said non-parallel spacer having a spacer first axial surface and a spacer second axial surface, said first axial surface and said second axial surface having a pre-defined non-parallelism therebetween; and b) mounting a nut on a threaded portion of said shaft such that at least one of said spacer first axial surface and said spacer second axial surface mates with an axial face of at least one component of said rotor group.

21. The method of claim 20, wherein:

said step a) comprises mounting said non-parallel spacer between said nut and said rotor group such that said non-parallel spacer is disposed adjacent to said nut.

22. The method of claim 20, wherein the method further comprises the steps of, prior to said step a):

c) assembling said plurality of rotor components on said shaft;

d) installing a parallel spacer and a nut on said shaft;

e) via said nut, compressing said plurality of rotor components on said shaft to provide a pre-balanced rotor assembly;

f) measuring unbalance or bow of said pre-balanced rotor assembly;

g) calculating non-parallelism of a non-parallel spacer sufficient to correct for said unbalance or bow measured in said step f);

h) providing said non-parallel spacer;

i) removing said nut from said shaft; and wherein said step a) comprises:

j) replacing said parallel spacer with said non-parallel spacer.

* * * * *